United States Patent [19]

Tell et al.

[11] Patent Number: 4,560,438

[45] Date of Patent: Dec. 24, 1985

[54] METHOD AND APPARATUS FOR REDUCING THE ENERGY CONSUMED WHEN DRYING A PAPER WEB

[75] Inventors: Lars E. K. A. Tell, Karlstad; Carl C. E. Johannesson, Forshaga, both of Sweden

[73] Assignee: KMW Aktiebolag, Karlstad, Sweden

[21] Appl. No.: 615,997

[22] Filed: May 31, 1984

[30] Foreign Application Priority Data

Jun. 1, 1983 [SE] Sweden ..... 8303075

[51] Int. Cl.[4] ..... D21F 11/00

[52] U.S. Cl. ..... 162/194; 162/191; 162/195; 162/286; 162/308; 162/310

[58] Field of Search ..... 162/191, 195, 264, 194, 162/286, 306, 310, 308

[56] References Cited

U.S. PATENT DOCUMENTS 1,945,118 1/1934 McVicker et al. ..... 162/264

1,949,188 2/1934 Smith ..... 162/191

FOREIGN PATENT DOCUMENTS 742065 12/1955 United Kingdom ..... 162/195

*Primary Examiner*—Peter Chin

*Attorney, Agent, or Firm*—Bell, Seltzer, Park & Gibson

[57] ABSTRACT

A method and apparatus which reduces the amount of energy consumed in drying a paper web are disclosed. The reduction is accomplished by trimming the paper web while it is being conveyed on a moving fabric to divide the formed web into a trimmed web and couch trimmings respectively. Thereafter, suction is applied in the area where the pick-up of the trimmed web from the fabric is accomplished so as to deflect the portion of the felt on which the couch trimmings lie. As a result, only the trimmed web is conveyed to the drying section so that no energy is expended in drying the couch trimmings. The apparatus and method is particularly applicable to the manufacture of paper having a low grammage (basis weight) since contact between the couch trimmings and the pick-up felt is avoided.

6 Claims, 3 Drawing Figures

METHOD AND APPARATUS FOR REDUCING THE ENERGY CONSUMED WHEN DRYING A PAPER WEB

BACKGROUND OF THE INVENTION

The present invention relates to a method and an apparatus for reducing energy consumption when drying a paper web in a paper machine drying section, which web is formed on a fabric in the wire part of the paper machine, picked up from the fabric by pick-up means, and is thereafter conveyed to and through the drying section. The paper web is trimmed in the wire part of the machine by means of edge cutters so as to divide it into a trimmed web and couch trimmings while the web is being conveyed on a forming side of the fabric.

The paper web formed in the paper machine originally is of varying width and its edges are uneven with respect to straightness, thickness and grammage (basis weight). The finished paper web must be trimmed before reeling, and the widths of the edge portions cut away may be considerable due to the variation in width of the paper web. Furthermore, when manufacturing tissue, for example, the paper web also has to be slit into a plurality of webs of a predetermined width and wound again, which may cause additional waste.

The dried broke obtained when cutting the edge portions at a winder is very voluminous, which makes it difficult to collect and convey out of the way. This dried paper is slushed in water and recirculated to the paper manufacturing process. In light of the high energy costs which prevail today, the dried broke normally obtained during the manufacture of paper is a large problem.

It has been suggested, see U.S. Pat. No. 2,686,463 (Hornbostel) and U.S. Pat. No. 2,709,398 (Beachler), to reduce the energy consumed in the paper manufacturing process, primarily in the drying of the paper web, by trimming the web so that it is divided into a trimmed web and couch trimmings while it is being conveyed on the forming fabric, and picking up the trimmed web through the use of suction from the fabric for conveyance to and through the drying section, while attempting to avoid conveyance of the couch trimmings to the drying section.

It has been found, however, that the above earlier known technique is not effective when applied to paper grades of low grammage, such as tissue, because the couch trimmings have the tendency to adhere to the pick-up felt used for picking up the trimmed web and consequently the trimmings have had the tendency of accompanying the trimmed web to and through the drying section. The object of the present invention is to provide an improvement in this regard in that contact between the trimmings and the pickup felt is avoided.

SUMMARY OF THE INVENTION

The object of the invention is achieved in a method according to the invention by retaining the couch trimmings on the fabric through the use of suction which is applied through the fabric from the reverse side of the fabric from the side on which the web is formed when picking up the trimmed web from the fabric. The suction is applied in a manner so as to displace the edge portions of the fabric, which edge portions carry the couch trimmings, from a plane of a main portion of the fabric in an area where the trimmed web is picked up from the fabric, and then removing the retained couch trimmings from the fabric.

In a corresponding manner the object of the invention is achieved in an apparatus made in accordance with the invention which comprises suction means acting from the reverse side of the fabric for retaining the couch trimmings on the fabric when the trimmed web is being picked up from the fabric to be conveyed to and through the drying section. In addition, means are provided for removing the couch trimmings which remain on the fabric. The suction means may be a suction box having a slot of a length that substantially corresponds to the width of the couch trimmings, said suction box being preferably located some few millimeters under the plane of the fabric, and in any event being capable of developing a suction force that is sufficient for displacing the edges of the fabric which carry the couch trimmings from the fabric plane in the area where the picking-up of the trimmed web from the fabric is accomplished.

The advantage of the invention is primarily that it may be applied in manufacturing paper grades of low grammage, e.g., tissue, without causing web breakage or the like when picking up the trimmed paper web from the fabric, while also avoiding picking up the couch trimmings together with the trimmed web.

A special advantage is also gained in that the couch trimmings are consequently removed in the stated manner from the paper web before the paper web is dried, which results in a considerable reduction of the energy consumed in drying the paper web. In addition, the collection and the slushing of the trimmings are facilitated, and the slushing will require less energy than if the trimmings were dried prior to being separated from the paper web. Further, the paper-making fibers liberated by the slushing of undried paper are of a higher quality.

DESCRIPTION OF THE DRAWINGS

Additional features that characterize the invention are described in greater detail below in connection with the drawings wherein.

DETAILED DESCRIPTION

Figure 1:
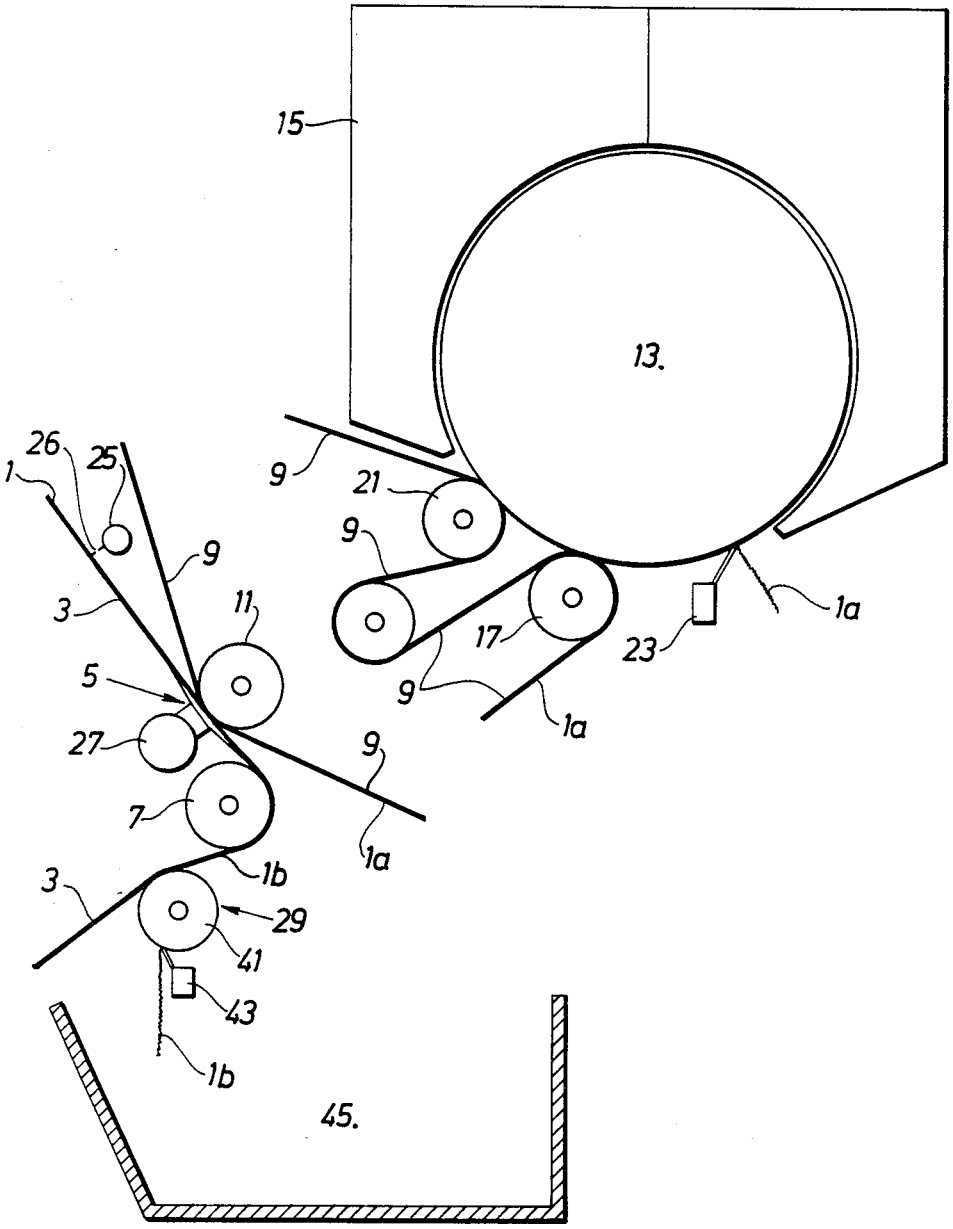
FIG. 1 is a schematic side view of portions of a wire part and a drying section, respectively in a paper machine provided with a preferred embodiment of an apparatus according to the invention.

FIG. 1, in the lower left-hand corner, illustrates how a paper web 1, which can be of a low grammage and which has been formed on a forming fabric 3 in the wire part of the paper machine, is carried by the fabric 3 and is thereby conveyed to a pick-up location, generally designated by 5. The fabric may be one of the wires in a twinwire former, e.g., the outer wire, but if desired it may be the fourdrinier wire in a fourdrinier former. The fabric 3 is shown running past the pick-up location 5 and further around the circumference of a wire turning roll 7, where the fabric turns back to the forming zone (not shown) of the paper machine.

In an apparatus according to the invention, edge cutters 25 are provided for dividing the formed paper web 1 into a trimmed web 1*a* and couch trimmings 1*b* as more fully described hereinafter. At the pick-up location the trimmed web 1*a* is picked up from the fabric 3 by pick-up means, which in the shown embodiment comprises a pick-up felt 9 and a pick-up roll 11, which causes the felt 9 to contact the trimmed web 1*a* for transferring the web 1*a* from the fabric 3 to the felt 9. Instead of the pick-up roll 11, a pick-up shoe or the like (not shown) may be used and, if desired, the roll 11 or the shoe, respectively, may be of the suction type to facilitate the transfer of the trimmed web 1*a* from the fabric 3 to the felt 9 by means of suction. In some applications and if desired, the felt may be of the wire or fabric type in spite of its being called a felt.

As shown in the upper right-hand portion of FIG. 1, the felt 9 conveys the trimmed web 1*a* to the drying section of the paper machine, which in the shown embodiment comprises a Yankee dryer 13 and a cooperating hot air hood 15. The trimmed web 1*a* is transferred in a conventional manner from the felt 9 to the Yankee dryer 13 by means of a press roll 17, which may be a suction roll. In the shown embodiment, the felt 9 runs from the nip between the press roll 17 and the Yankee dryer 13 in a loop around a guide roll 19 and through a second nip formed between the Yankee dryer 13 and a second press roll 21 for additional dewatering of the trimmed web 1*a* before the web, carried on the envelope surface of the Yankee dryer 13, is brought in under the drying hood 15. When the trimmed web 1*a* emerges from under the drying hood 15, it will be removed from the envelope surface of the Yankee dryer 13, in the shown embodiment by means of a creping doctor 23, and is thereafter passed on to a reel-up (not shown) for reeling the paper web produced.

To lower the energy consumption during the drying of the paper web, the paper machine is, in accordance with the invention, provided with edge cutters 25 for trimming the web 1 by discharging a fluid or air jet 26 to divide it into a trimmed web 1*a* and couch trimmings 1*b* while the web is being conveyed on the fabric 3, suction means 27 for retaining the couch trimmings 1*b* on the fabric 3 when the trimmed web 1*a* is picked up from the fabric 3 to be conveyed to and through the drying section (13–15), and means 29 for removing the retained couch trimmings 1*b* from the fabric 3.

In the shown preferred embodiment (FIG. 1) said edge cutters 25 are water or air nozzle means, positioned to divide the formed web 1 by means of a jet 26 of water or air into a trimmed web 1*a* and couch trimmings 1*b*. The nozzle means 25 — there are suitably two of them for cutting away an edge portion each — located somewhat upstream of the pick-up location 5 for the trimmed web 1*a*. The nozzles are arranged so as to provide sufficient spacing between the fabric 3 and the felt 9, which form a nip at the pickup location 5.

Figure 2:
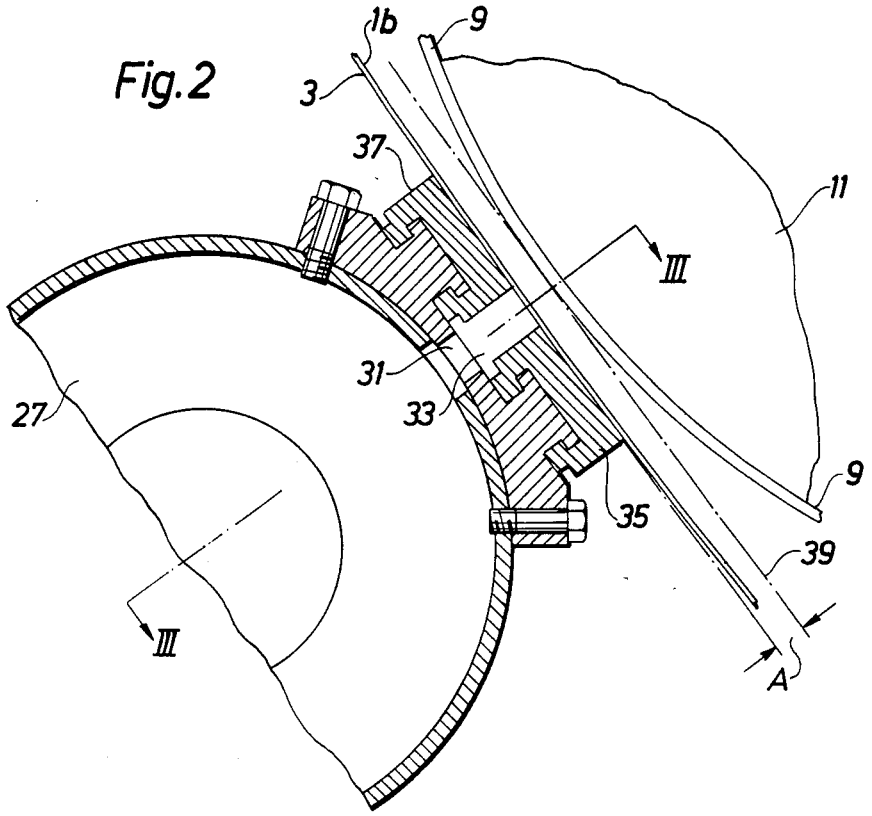
FIG. 2 is a vertical section along line II—II in FIG. 3, and shows a preferred embodiment of the invention as utilized in the area for picking up the paper web from the forming fabric and shows among other things a suction box located in the pick-up area.
Figure 3:
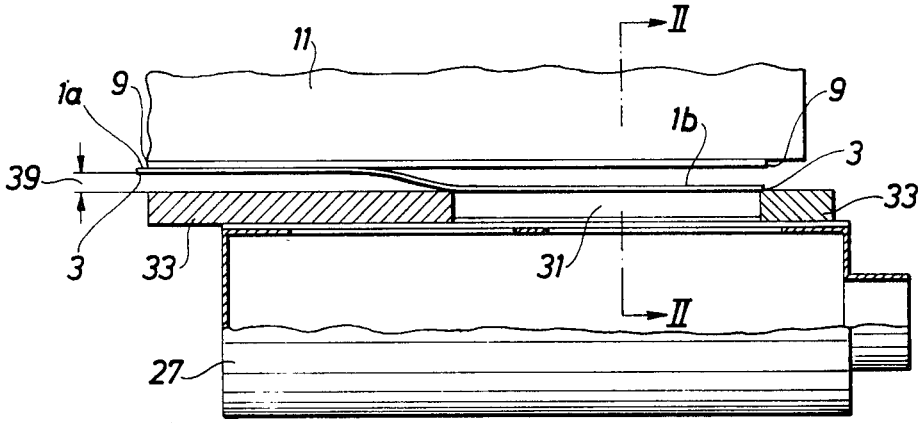
FIG. 3 is a section according to line III—III in FIG. 2 and shows how a suction box having an adjustable slot length displaces an edge portion of the fabric from the plane of the fabric in the pick-up area.

Further, in the preferred embodiment, said suction means comprise a separate suction box 27 for each of the couch trimmings. As is best illustrated in FIGS. 2 and 3, the suction box 27 has a suction slot 31 of a length that substantially corresponds to the widths of the couch trimmings 1*b*. The adaptation of the length of the suction slot 31 to the actual widths of the couch trimmings 1*b* can be carried out, as is obvious from FIG. 3, by adjusting two deckle fingers 33 axially displaceable in the slot 31. Of course, if desired, the suction box 27 may comprise a plurality of slots positioned side by side when viewed in the machine direction.

As illustrated in FIGS. 2 and 3, the suction box 27 is suitably mounted in such a way that the wear surface of the preferably reversible and replaceable wear strips 35, 37 that define the suction slot 31, which wear surface faces the under side of the fabric 3, is preferably located at a distance A (FIG. 2) of some few millimeters, suitably about 2 mm, under the plane 39 of the fabric 3. The suction box 27 is able to develop a suction force that is sufficient for displacing the fabric edge portion carrying the couch trimmings 1*b* from the fabric plane 39 in the area for the picking-up of the trimmed web 1*a* from the fabric 3. At the pick-up location 5, the trimmed web 1*a* — consequently brought into contact with the felt 9 carried by the pick-up roll 11 while each suction box 27 by suction from the reverse side of the fabric 3 has displaced from the fabric plane 39 the fabric edge portions carrying the trimmings, so that the couch trimmings 1*b* do not contact the pick-up felt 9 and, consequently, do not accompany the felt and the trimmed web 1*a* to the drying section.

As shown in FIG. 1, the means 29 for removing the retained couch trimmings 1*b* from the fabric 3 comprises a fabric roll 41 located externally of the fabric loop and having a plain surface for picking up the couch trimmings 1*b* from the fabric 3, and means 43 for showering or doctoring off the couch trimmings 1*b* from the fabric roll 41. In the embodiment according to FIG. 1, the means 43 is shown to comprise a doctor.

Usually, the paper machine includes a wire pit 45 located under the downstream end of the wire part. In that event, the means 29 for removing the retained couch trimmings 1*b* are preferably located so as to let the couch trimmings 1*b* drop down into the wire pit 45.

As an example of the reductions in energy consumption which may be achieved in the drying section alone through the use of the invention, in one case the original width of the web was about 3 meters and edge trimmings having a width of about 0.1 meter on each side of the web were separated from the web in accordance with the invention, which resulted in that the energy consumption for the drying step, which was carried out on a Yankee dryer, was lowered by more than 5%.

The drawings and descriptions set forth herein are concerned with preferred embodiments made in accordance with the claimed invention. They should not be construed, however, as imposing any limitations on the claimed invention.

That which is claimed is:

1. A method for reducing the amount of energy consumed in the drying section of a paper machine in which a paper web is formed on a moving fabric and is thereafter picked up and transferred from the fabric and conveyed to and through a drying section, said method comprising trimming the formed web which the web is being conveyed on the fabric so as to divide the web into a trimmed web and couch trimmings extended along each edge thereof, applying suction to the fabric on the reverse side of the fabric from the web in preselected areas where the couch trimmings lie so as to displace the portions of the fabric upon which the couch trimmings lie and to retain the couch trimmings by suction on the fabric and while transferring only the trimmed paper web from the fabric to the drying section, and separating the retained couch trimmings from the surface of the fabric.

2. A method according to claim 1 wherein the step of separating the retained couch trimmings from the fabric comprises picking up the couch trimmings by means of a roll and thereafter removing the couch trimmings from the roll.

3. An apparatus for reducing the amount of energy consumed in the drying section of a paper machine which includes a wire part for forming a paper web on a moving fabric and a drying section for receiving and drying the formed web, said apparatus comprising trimming means for trimming the formed web while the web is being conveyed on the fabric so as to divide the formed web into a trimmed web and couch trimmings extending along each edge thereof, pickup means for transferring the trimmed web from the fabric and conveying it to the drying section, suction means containing openings therein positioned adjacent said pickup means and on the reverse side of the fabric from the web for applying suction to preselected portions of the reverse side of the fabric in the areas where the couch trimmings lie so as to displace the portions of the fabric upon which the couch trimmings lie away from such pickup means and to retain the couch trimmings by suction on the fabric so that said pickup means contacts only the trimmed paper web for conveyance to the drying section, and means for removing the retained couch trimmings from the fabric.

4. An apparatus according to claim 3 wherein said suction means includes means for adjusting the size and the space between the suction openings in accordance with the width of the trimmed paper web.

5. An apparatus to claim 3 wherein said suction means comprises a suction box and wherein said means for removing the couch trimmings from the fabric comprises a roll and a doctor blade cooperating with the roll for separating the retained couch trimmings from the surface of the roll.

6. An apparatus according to claim 3 additionally comprising a wire pit located under said wire part of the paper machine and wherein said means for removing the couch trimmings from the fabric is located above the wire pit so that the couch trimmings fall into the wire pit upon their removal from the fabric.

* * * * *